United States Patent [19]

Kinouchi

[11] Patent Number: 4,730,540

[45] Date of Patent: Mar. 15, 1988

[54] CYLINDER FOR A TWO CYCLE ENGINE

[75] Inventor: Sosuke Kinouchi, Kakogawa, Japan

[73] Assignee: Kawasaki Jukogyo Kabushiki Kaisha, Kobe, Japan

[21] Appl. No.: 879,302

[22] Filed: Jun. 27, 1986

[30] Foreign Application Priority Data

Jul. 12, 1985 [JP] Japan ..... 60-154897

[51] Int. Cl.[4] ..... F15B 15/22; F01B 11/02

[52] U.S. Cl. ..... 91/25; 91/402; 92/169; 29/156.4 R; 51/290

[58] Field of Search ..... 91/25, 357, 402; 92/169 R; 29/156.4 R, 156.4 WL; 51/281 P, 290, 291, 316

[56] References Cited

U.S. PATENT DOCUMENTS

Re. 18,644 11/1932 Yount ..... 29/156.4 WL
755,324 3/1904 Soley ..... 91/25
4,196,547 4/1980 Keske ..... 51/290 X

FOREIGN PATENT DOCUMENTS 60-175845 11/1985 Japan .
2135423 8/1984 United Kingdom ..... 91/402

OTHER PUBLICATIONS

"Cylinder Boring, Honing, and Wall Finishing", Brush Research Manufacturing Co.

*Primary Examiner*—Robert E. Garrett
*Assistant Examiner*—Mark A. Williamson
*Attorney, Agent, or Firm*—Leydig, Voit & Mayer

[57] ABSTRACT

The cylinder for a two cycle engine includes at least a port opened and closed by a piston in the cylinder the port being divided into a plurality of port portions by a rib extending longitudinally of the cylinder. The inner surface of the cylinder is formed with elongated concave recesses at the respective ends of the rib extending in the direction of extension thereof for regulating the pressing force per unit area of honing process. Each of the concave recesses has preferably substantially the same width as the width of the rib and the sum of the lengths of the concave recesses is preferably substantially the same as the length of the port.

4 Claims, 3 Drawing Figures

CYLINDER FOR A TWO CYCLE ENGINE

BACKGROUND OF THE INVENTION

The present invention relates to a cylinder for a two cycle engine, and, more particularly, to an improved construction of a cylinder for a two cycle engine wherein at least one port formed in the cylinder and opened and closed by a piston reciprocally moved in the cylinder is divided into a plurality of port portions by at least a rib formed in the cylinder and extending longitudinally of the cylinder.

Heretofore, in a cylinder for a two cycle engine, the width of the exhaust port has been increased in order to enhance the performance of the engine and at least a rib is provided in the exhaust port extending longitudinally of the cylinder for preventing the piston ring from catching the upper edge of the exhaust port, thus dividing the port into a plurality (usually two) of port portions each having a narrow width. However, if such a rib is provided, a portion of the rib is made in a swollen form projecting into the interior of the cylinder even though having a honing procedure carried out on the inner surface of the cylinder, thereby tending to cause seizure of the piston. In other words, in the honing process, a plurality of elongated grindstones arranged in parallel to the center line of the cylinder are pressed against the inner surface of the cylinder under a constant load while they are rotated around the center line in contact with the inner surface of the cylinder and, at the same time, they are moved up and down therein. Therefore the area of the inner surface of the cylinder in contact with these grindstones becomes small due to the provision of the port when the grindstones move across the port so that the pressure per unit area is increased, whereas, when the grindstones move across the rib, the area of the inner surface of the cylinder (including the rib) in contact with the grindstones is increased due to the provision of the rib so that the pressure per unit area is reduced thereby resulting in less grinding effect. Thus, a portion of the rib tends to swell and project into the interior of the cylinder so that the accuracy of the cylindrical shape of the inner surface of the cylinder is reduced, tending to cause seizure of the piston in the inner surface of the cylinder. To avoid the above defect, the honing apparatus has been so improved that the inner diameter of the cylinder can be checked in order to vary the pressing force of the grindstones to prevent local swelling of the rib and to achieve a highly accurate cylindrical shape of the inner surface of the cylinder. However, such a honing apparatus is complicated and requires a high cost. Therefore, at present, it is necessary to finish the inner surface of the cylinder by hand after the honing operation, thereby requiring a great time expenditure and high skill resulting in problems of a high cost and variation in the quality.

SUMMARY OF THE INVENTION

An object of the present invention is to provide a cylinder for a two cycle engine in which the above described defects are avoided and high accuracy of the cylindrical shape of the inner surface of the cylinder of the engine is achieved even though the port is divided by the rib.

According to the present invention, a cylinder for a two cycle engine is provided in which a port formed in the cylinder and opened and closed by a piston reciprocally moved in the cylinder is divided into a plurality of port portions by a rib or ribs extending longitudinally of the cylinder, the cylinder being characterized in that elongated concave recesses are formed in the inner surface of the cylinder at the respective ends of the rib or ribs extending in the direction of extension thereof in order to regulate the pressure per unit area of the grindstones in the honing process.

DETAILED DESCRIPTION OF THE PREFERRED EMBODIMENT

Figure 1:
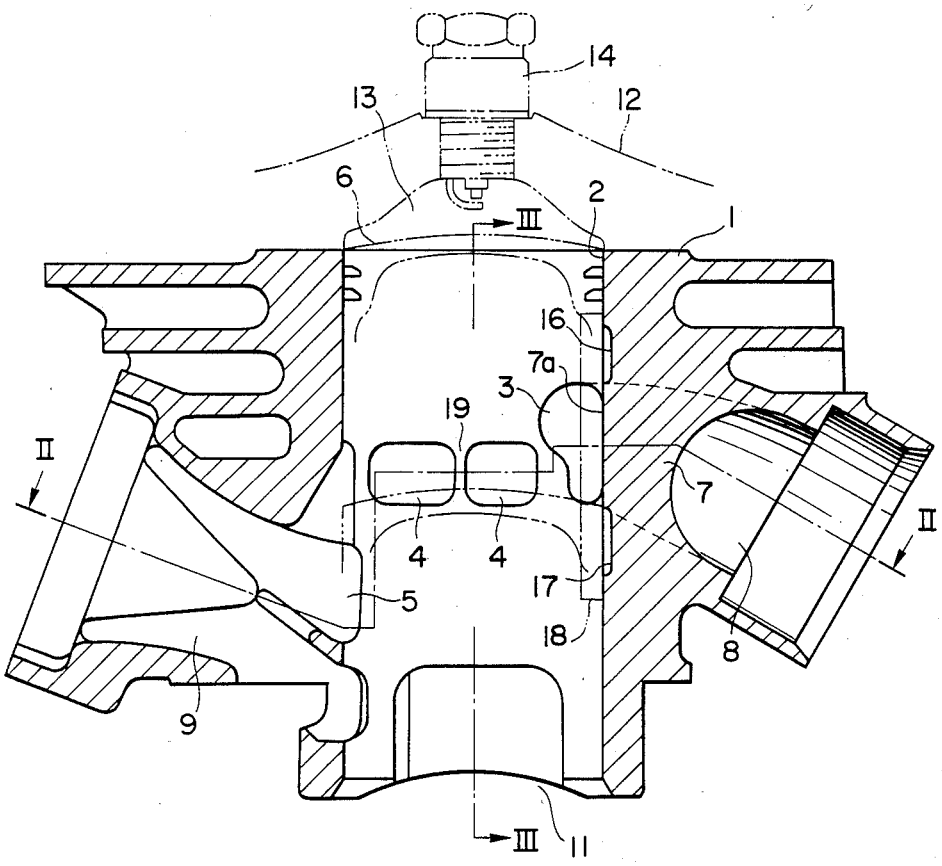
FIG. 1 is a longitudinal sectional view of a cylinder for a two cycle engine according to the present invention.
Figure 2:
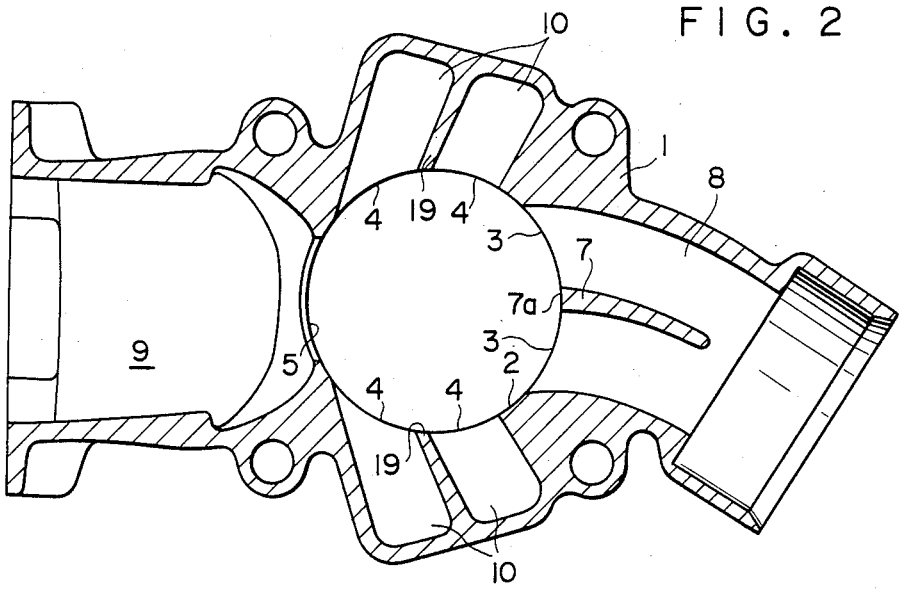
FIG. 2 is a sectional view as seen in the direction of arrows II—II in FIG. 1.
Figure 3:
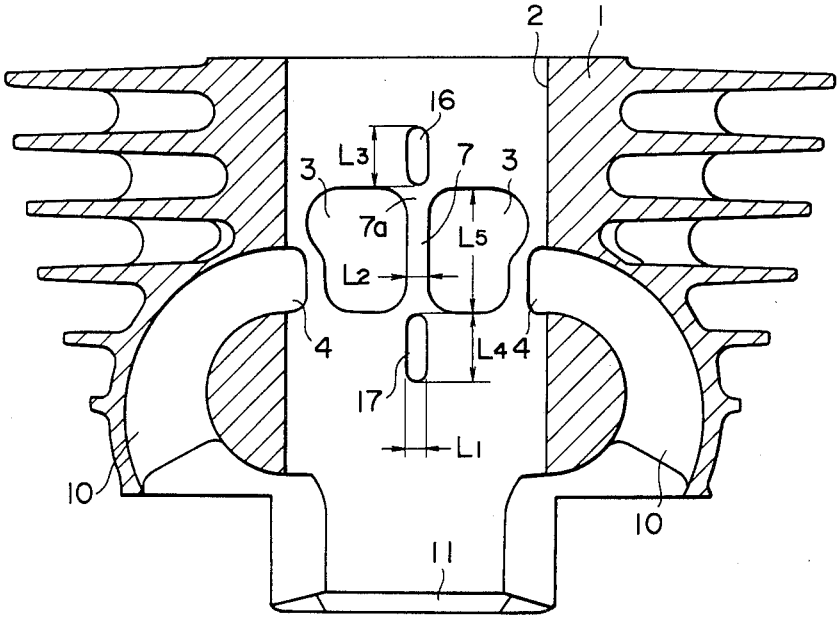
FIG. 3 is a sectional view as seen in the direction of the arrows III—III in FIG. 1.

In an embodiment illustrated in the drawings, a cylinder 1 made of cast iron is provided in its inner surface 2 with two exhaust ports 3, four scavenging ports 4 and an intake port 5, and a piston 6 is shiftably engaged in the inner surface 2, and this piston 6 serves as valve means for opening and closing these ports. A rib 7 located between the two exhaust ports 3 is in the form of a plate extending longitudinally of the cylinder 1 as clearly shown in FIGS. 2 and 3, and the inner surface 7*a* of the rib 7 at the side of the interior of the cylinder 1 forms a part of the inner surface of the cylinder 1. The exhaust ports 3, 3 communicate with an exhaust passage 8 which in turn communicates with atmosphere through an exhaust pipe (not shown) and a muffler (also not shown). The intake port 5 communicates with an intake passage 9 which in turn communicates with atmosphere through a carburetor (not shown) and an air cleaner (also not shown). The scavenging ports 4 communicate with a crank chamber 11 located at a position beneath the piston 6 through scavenging passages 10 shown in FIGS. 2 and 3. A cylinder head 12 is tighlty secured to the upper end of the cylinder 1 by a plurality of bolts (not shown) as shown in FIG. 1 so that a combustion chamber 13 is formed in the cylinder 1 between the cylinder head 12 and the piston 6. The reference numeral 14 designates an ignition plug. A crank case (not shown) is secured to the lower end of the cylinder 1 in the conventional manner.

Shallow elongated concave recesses 16, 17 are formed by a casting operation in the inner surface 2 of the cylinder 1 extending upwardly from the upper end of the rib 7 and downwardly from the lower end of the rib 7 in the direction of extension thereof, respectively. The width L1 (FIG. 3) of each of the concave recesses 16, 17 is substantially the same as the width L2 of the rib 7, and the sum of the lengths L3 and L4 of the concave recesses 16, 17 longitudinally of the cylinder 1 is substantially the same as the length L5 of the exhaust ports 3. The upper and lower ends of each of the recesses 16, 17 are in the form of a smooth semicircle, and the depth is 1 mm, for example. When used, honing grindstones 18 extend in the longitudinal direction parallel to the center line of the cylinder 1 and each of the grindstones 18 has a substantially rectangular cross-section. The honing grindstones 18 are pressed against the inner surface 2 of the cylinder 1 under a constant load by a spring mechanism (not shown) arranged at the back of the grindstones 18.

When honing process is applied to the inner surface 2 of the cylinder 1, the honing grindstones 18 are pressed against the inner surface 2 of the cylinder 1 under a predetermined load with the grindstones 18 held parallel to the center line of the cylinder 1, and they are rotated around the centerline of the cylinder 1 in contact with the inner surface 2, while they are repeatedly moved up and down. With the above construction, the honing grindstones 18 applying the grinding action to the area of the inner surface 2 of the cylinder 1 adjacent to the exhaust ports 3 have the same contact area with the inner surface 2 when they are moving across the inner surface 7*a* of the rib 7 as the contact area when they are moving across the area of the exhaust ports 3 where the rib 7 is not provided, because the concave recesses 16, 17 are provided at the upper and lower ends of the rib 7 extending in the direction of extension thereof. In other words, the grindstones 18 do not contact with the area of the concave recesses 16, 17 when they are moving across the rib 7 so that the contact area of the honing grindstones 18 is kept small in comparison with the case in which no concave recesses are provided, while, when the honing grindstones 18 are moving across the area of the exhaust ports 3 when the rib 7 is not provided, the grindstones 18 do not contact with the area of the exhaust ports 3, and, therefore, the contact area of the honing grindstones 18 is kept small. Since the sum of the areas of the concave recesses 16, 17 is substantially the same as the area of the inner surface 7*a* of the rib 7 by virtue of the setting of the width L1 of these recesses 16, 17 to be substantially the same as the width L2 of the rib 7 while the sum of the lengths L3, L4 of the recesses 16, 17 is set to be substantially the same as the length L5 of the exhaust port 3, the contact area of the honing grindstones 18 is kept substantially the same regardless of whether they are moving across the area of the exhaust ports 3 without the rib 7 or they are moving across the rib 7. Therefore, since the pressing load applied to the grindstones 18 by the spring mechanism arranged at the back thereof is set to be constant, the pressing force per unit area of the honing stones 18 when they are moving across the inner surface 7*a* of the rib 7 will not be reduced in comparison with the pressing force per unit area when they are moving across the exhaust ports 3 without the rib 7. Thus, the honing rate is kept the same regardless whether the honing grindstones 18 are moving across the rib 7 or moving across the area of the exhaust ports 3 without the rib 7. A rib 19 is also formed between each of the adjacent two scavenging ports 4. The ribs are not so severely heated in comparison with the area adjacent to the exhaust ports 3 and, therefore, danger of seizure of the piston to the inner surface 2 of the cylinder 1 is reduced even though some swelling of the inner surface of the rib 19 occurs. In case a cast iron liner is press-fitted into the cylinder made of aluminum when the present invention is carried out, slits may be formed in the liner. Further, chromium plating may be applied to the inner surface of the cylinder made of aluminum having concave recesses formed in the inner surface thereof.

In the present invention, as described above, since the concave recesses 16, 17 are formed in the inner surface 2 of the cylinder 1 at the upper and lower ends of the rib 7 extending in the direction of extension thereof for regulating the pressing force per unit area in the honing process, the honing process can be effected wtihout causing the swelling of the inner surface 7*a* of the rib 7 projecting into the interior of the cylinder 1 beyond the inner surface 2 thereof, and, therefore, no finishing process by the hand of an operator is required after the honing process, and seizure of the piston within the cylinder can be avoided. The inner surface 2 of the cylinder is also so configured that the piston ring is prevented from catching the upper edge of the exhaust ports. In such a case, seizure of the piston can more effectively be prevented.

What is claimed is:

1. In a cylinder for a two cycle engine comprising a port formed in said cylinder and opened and closed by a piston in said cylinder, said port being divided into a plurality of port portions by rib means extending in the longitudinal direction of said cylinder, said cylinder further provided with elongated concave recesses in the inner surface of said cylinder at the respective ends of said rib means extending in the direction of extension thereof for regulating the pressing force per unit of honing process.

2. Cylinder for a two cycle engine according to claim 1, wherein said port is at least one of an inlet port, an exhaust port and a scavenging port.

3. Cylinder for two cycle engine according to claim 1, wherein each of said elongated concave recesses has substantially the same width as the width of said rib means, and the sum of the lengths of said elongated concave recesses is substantially the same as the length of said port.

4. Cylinder for a two cycle engine according to claim 1, wherein said concave recesses comprise casting holes or slits in a liner in said cylinder.

* * * * *